United States Patent [19]

Schillinger

[11] 4,377,252

[45] Mar. 22, 1983

[54] CONVERTIBLE EIGHT-CELL CARTON

[75] Inventor: Joseph F. Schillinger, Fulton, Ill.

[73] Assignee: Champion International Corporation, Stamford, Conn.

[21] Appl. No.: 299,976

[22] Filed: Sep. 8, 1981

[51] Int. Cl.[3] ..... B65D 5/48; B65D 5/50

[52] U.S. Cl. ..... 229/28 R; 229/15; 229/41 B

[58] Field of Search ..... 229/28 R, 15, 41 B, 229/27

[56] References Cited

U.S. PATENT DOCUMENTS

| | | | |
|---|---|---|---|
| 3,626,494 | 12/1971 | Levin | 229/15 |
| 3,825,174 | 7/1974 | Booth | 229/28 R |
| 4,172,550 | 10/1979 | Garman | 229/28 R |
| 4,192,444 | 3/1980 | Garman | 229/28 R |
| 4,211,359 | 7/1980 | Chaffin | 229/28 R |
| 4,219,147 | 8/1980 | Kohler | 229/41 B |
| 4,347,967 | 9/1982 | Landermille | 229/15 |

*Primary Examiner*—Herbert F. Ross

*Attorney, Agent, or Firm*—Evelyn M. Sommer

[57] ABSTRACT

A multi-compartment collapsible container made from a single integral blank is folded up and appropriately spotted with adhesive so that compartment forming panels extending from sections of the end walls and bottom walls lie in surface-to-surface relation initially with the end walls and side walls. The container thus manufactured may be shipped flat and erected at the place of the user by pushing on opposite ends of the folded carton in order to erect the carton with a longitudinal central partition and additional partitions extending from the longitudinal central partitions towards the side walls to create alternatively an erectible carton having eight cells in two rows of four with the cells being of substantially equal size or a carton having a pair of cells at each end, totalling four end cells with two larger cells intermediate the end cells which larger cells may themselves be convertible into smaller cells of equal size with the end cells totalling eight in all.

8 Claims, 12 Drawing Figures

CONVERTIBLE EIGHT-CELL CARTON

The present invention is an improvement and modification of the invention disclosed in U.S. Pat. No. 4,219,147, issued Aug. 26, 1980, and assigned to the assignee of the present invention.

This invention relates to a multicelled, collapsible carton and the blank for forming the same. The carton can be shipped in knocked-down condition and can readily be erected by the purchaser prior to the insertion of the articles to be protected and shipped therein. While the disclosure of the prior patent shows a six-cell collapsible carton, the present invention is directed to an eight-cell collapsible carton, as can readily be seen from the description of the carton itself as hereinafter set forth. The difference involves much more than the inclusion of an added partition and the step from a six-cell carton to an eight-cell carton, as described in the present invention, involves a variation in the structure of the blank which was not heretofore believed possible. While the carton is here described as an eight cell carton which may be convertible to six cells or seven cells, it is also possible by appropriate arrangement of the blank from which the carton is made to double the number of cells in the carton laterally to provide a composite single unit having two sets of rows of cartons with separate lids or it may be possible to extend the carton longitudinally in order to provide additional cells, at least some of which may be convertible. It is also possible to combine both concepts, lengthening the carton to provide additional cells and arranging the blanks so that from a single blank a pair of parallel integrated cartons may be formed the integrated cartons having two double rows of cells providing thereby four rows of cells in each carton. It may also be possible to triple the carton structure by appropriate arrangement of the blank as hereinafter described and to arrange the cartons to provide additional cells by multiplying the number of rows of cells and by extending the rows of cells or both.

In addition, the present invention is directed to a multicellular carton structure made from a single blank wherein the cells need not necessarily be of the same size, but may vary in size from cell to cell as packaging requirements indicate.

While the prior art has utilized dividers for forming cellular structures within cartons, the hingeable divider has consisted of a so-called egg crate partition assembly in which a series of slotted panels were placed together in a manner so that they could intersect each other and be folded from a flat position to an extended cellular position. This partition assembly was then placed in the carton. The problem that arose in connection with partitions of that general type was that after the container was erected and placed in condition to receive the articles, the partition had to be assembled, or at least unfolded, and also placed in the container. In addition, the container, since it did not have the partition walls as part thereof, required a separate assembly operation which often dictated that the container be shipped as an erected container.

The utilization of the partition elements as part of the container blank itself makes it possible by appropriate treatment in the blank of the side walls and especially the bottom walls of the container, and the various panels appended thereto, to create a collapsible and erectable completed carton having integral partitions, which partitions cooperate in forming the container within which they are placed.

A primary object of the present invention therefore is the provision of a multicellular carton which is collapsible and erectable and which may be shipped in flattened form and erected at the place of the user, wherein a single operation in moving the carton from its flat to its erected form also serves to erect the partitions within the carton.

While the foregoing object of the present invention is disclosed in U.S. Pat. No. 4,219,147, as heretofore mentioned, a further and primary object of the present invention is the provision of such a collapsible and erectable partioned carton wherein eight cells may be provided. It was previously thought, particularly in connection with the carton shown in the aforementioned patent, that a six cell carton was the maximum number of cells that could be included in a carton of the type in which all of the elements were integral, made from a single blank and arranged so that they could be erected and collapsed for shipment and erected once more at the place of the user. The advance of the present invention is based primarily on the recognition that additional elements may be inserted in such manner that an eight-cell carton may thereby be formed.

As a concomitant of the foregoing primary object of the invention, a further object of the present invention is the arrangement, in a partitioned container which is integral and made from a single blank and which may be shipped flat and erected at the place of the user, of a cellular structure in which certain of the cells may be made of different dimension from others of the cells without interfering with the collapsibility and erectability of the carton.

In addition, it is a further object of the present invention to provide a multi-cellular carton in which instead of merely two rows of cells, a plurality of rows of cells may be provided, all manufactured from a single blank and in which extended lengths of each cell row may be used. It should be borne in mind that while the six cell carton consisting of two rows of three cells has been standard, the concept of the present invention which provides for the convertibility of cells so that a single carton may selectively be used as a six cell, seven cell or eight cell carton can be extended to a concept where twelve basic cells are used at least one pair of which is convertible or twelve basic cells may be used in two rows of six at least one of which in each row is convertible and this may also be combined with a doubling or tripling of the structure so that mulitple rows of cells in addition to merely two rows of cells may be used.

A further object of the present invention is the arrangement of selectively erectable partitions in a larger cell or pair of cells so that the larger cell or pair of cells may each be converted into at least two cells matching substantially in size the other cells in the carton.

By this means, therefore, a user may be provided with a carton which may not only be shipped flat and erected just prior to use, thereby saving storage space and labor, but also a carton which may selectively be used to carry eight objects of the same size or it may be used to carry four objects of the same size and two much larger objects or arrangements, or it may be used to carry six objects of the same size and one much larger object or element. This would make it possible, for instance, to ship in the same carton a particular instrument or device which may be used in connection with the elements usually shipped in the carton, but which may be of a different size from the elements used and placed in the remaining cells; or it provides the option of shipping eight elements of the same size and arrangement.

The foregoing and many other objects of the present invention will become apparent in the following description and drawings in which.

Figure 1:
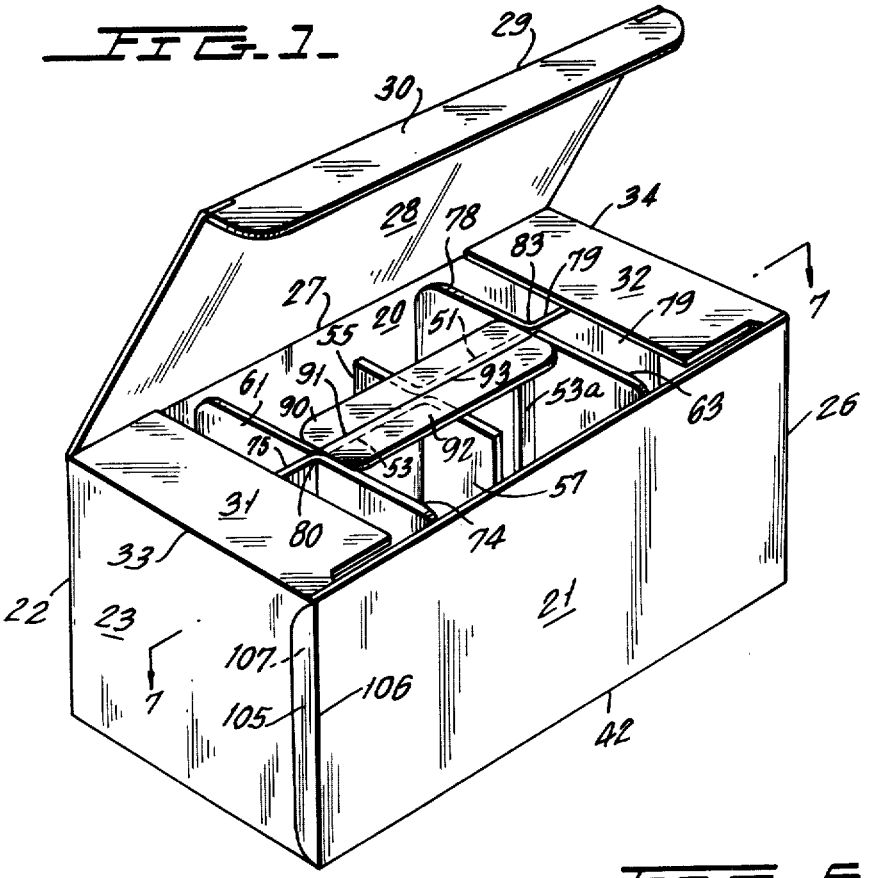
FIG. 1 is a view in perspective of the novel erected carton of the present invention.
Figure 6:
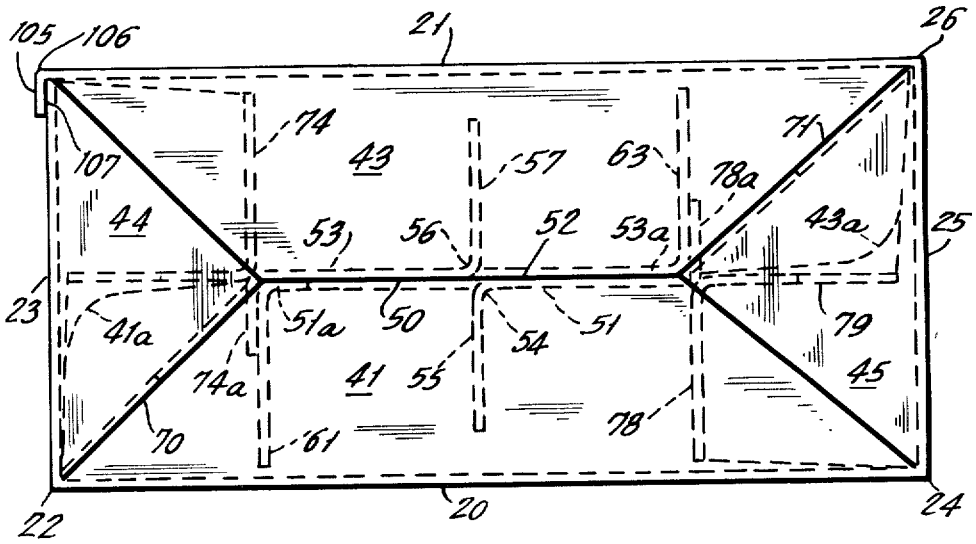
FIG. 6 is a bottom view of the carton of FIG. 1.
Figure 2:
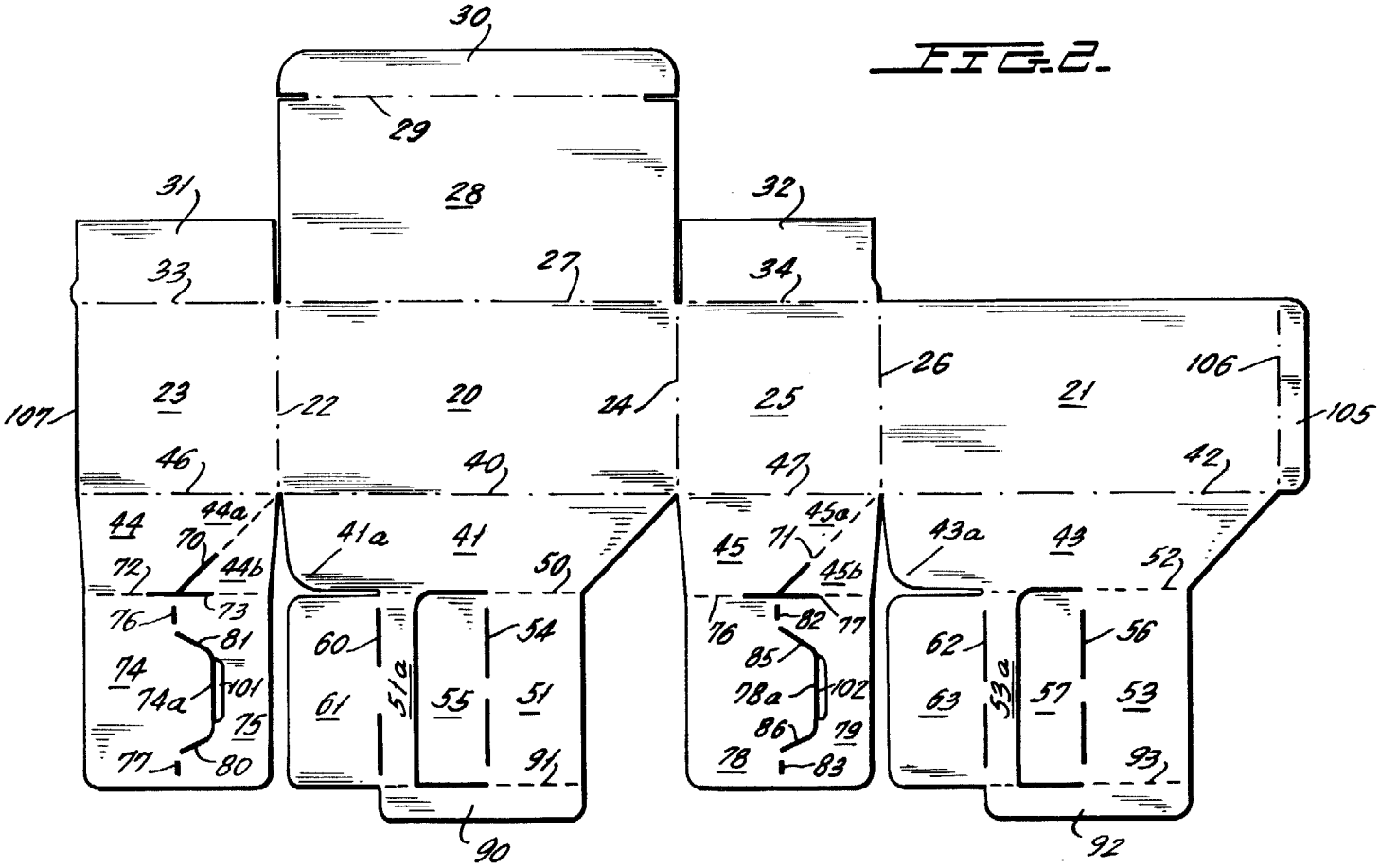
FIG. 2 is a plan view of the novel blank for forming the carton of FIG. 1.
Figure 5:
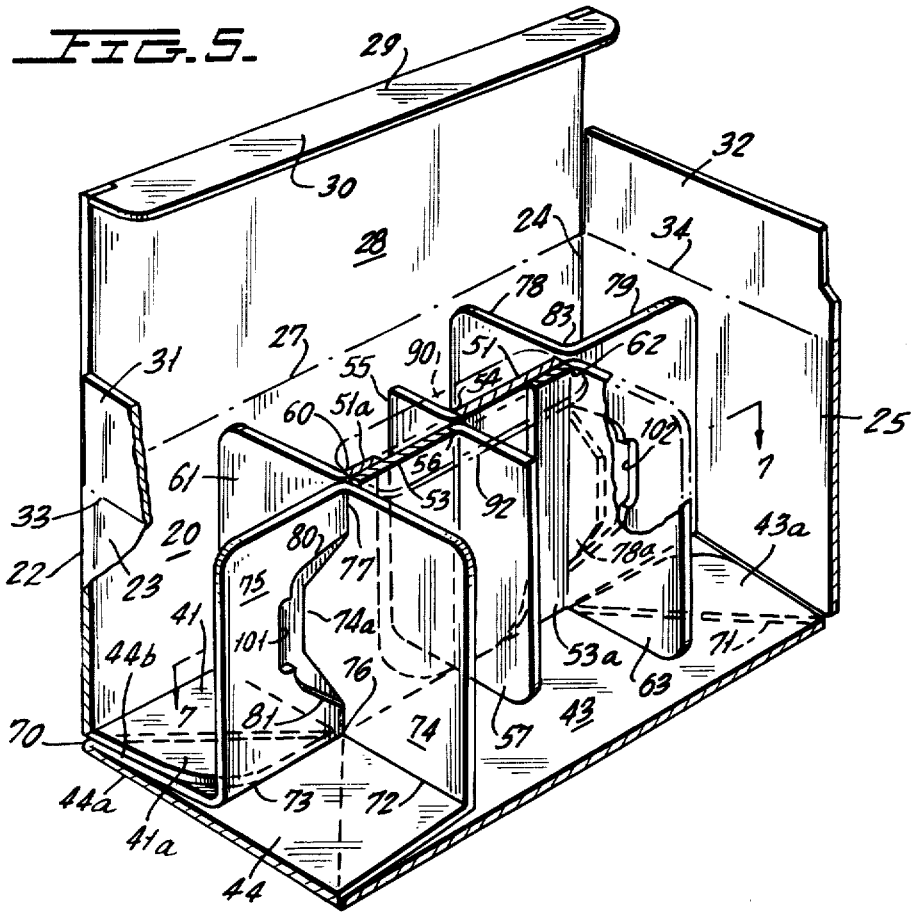
FIG. 5 is a view in perspective partly broken away showing the internal elements of the erected carton of FIG. 1.

The structure of the carton may more readily be understood from an examination of the blank of FIG. 2. In the following, the blank of FIG. 2 should be referred to, primarily, although the finished carton of FIG. 1 and the structure as shown in FIG. 5 will serve to amplify the description.

The blank of FIG. 2 is provided with the panel 20 which will form one of the side walls and the panel 21 which will form the opposite side wall. Panel 20 is connected by the fold line 22 to the panel 23 which forms one of the end walls. Panel 20 is connected at the opposite side by the fold line 24 to the panel 25 which forms the opposite end wall. Panel 25 is connected by the fold line 26 to the side wall panel 21. Side wall panel 20, which may be regarded as the vertical back of the carton when it is erected, is connected by the fold line 27 to the cover 28 which in turn is connected by the fold line 29 to the dust excluding tab 30 which will serve to engage the top edge of the opposite side wall 21 after the carton is erected and filled. The dust excluding tab 30 may be inserted inside the inner surface of the opposite side wall 21 or it may, where desired by the user, adhesively be secured over the top of the completed carton to the outside of the side wall 21.

The end walls 23, 25 are provided with dust flaps 31, 32. Dust flap 31 is connected by the fold line 33 to the upper surface of end wall 23 and dust flap 32 is foldably connected by the fold line 34 to the upper end of the side wall 25. In the completed carton shown particularly in FIG. 1, the dust flaps 31, 32 may be folded down on top of the contact of the carton from each of the end walls prior to the folding down of the cover 28, thereby providing an efficient closure for the carton.

Side wall 20 is connected at the bottom by the fold line 40 to the bottom panel 41 which, in the erected carton, constitutes substantially a longitudinal half of the bottom wall. Side wall panel 21 is connected by the fold line 42 to the bottom wall panel 43 which, in the erected carton, forms substantially the other longitudinal half of the bottom wall. The bottom wall of the carton is further completed by the panels 44 and 45. Panel 44 is hingedly connected by the fold line 46 to the bottom end of end wall 23. Panel 45 is hingedly connected by the fold line 47 to the bottom end of end wall 25.

Bottom wall panel 41 is connected by fold line 50 to the central longitudinal panel 51. Bottom wall panel 43 is connected by the fold line 52 to the central longitudinal panel 53. The central longitudinal panel 51 is connected by the fold line 54 to the partition flap 55 and the central longitudinal panel 53 is connected by the fold line 56 to the partition flap 57.

When the carton is erected to the position shown in FIGS. 1 and 5, the composite panels 51, 55, on the one hand, and 53–57, on the other hand, extend along the center part of the axial center line of the carton substantially in surface-to-surface relation with each other, although they are not connected. In the erected carton, partition flap 55 of panel 51 may be bent out and partition flap 57 of the panel 53 may also be bent out in opposite directions in order to provide a panel divider on each side of the central axis of the carton.

The panel 51 is extended beyond the flap 55 at section 51*a*. Section 51*a* of the panel 51 is connected by fold line 60 to partition panel 61. Similarly, panel 53 is extended beyond the fold out section 57 to panel section 53*a* which, in turn, is connected by fold line 62 to the partition panel 63. Panel 44 is divided into a trapezoidal segment 44*a* and the triangular segment 44*b*, the triangular segment being connected to the trapezoidal segment 44*a* by the fold line 70. Similarly, panel 45 is divided into a trapezoidal segment 45*a* and a triangular segment 45*b*. Triangular segment 45*b* is connected to the trapezoidal segment 45*a* by the fold line 71.

The composite panel 44, consisting of the elements 44*a*, 44*b*, is connected by the continuous fold line 72, 73 to the composite panel 74–75. Similarly, the composite panel 45 is connected by the continuous fold line 76–77 to the composite panel 78–79.

Section 74 of the composite panel 74–75 is connected by the fold lines 76, 77 to the section 75 of the composite panel. A tab 74*a* is excised along the arcuate lines 80 and 81 so that when the panel 74 is bent on the fold line 76–77 with respect to the panel 75, the tab 74*a* will rotate together with and as part of the panel section 74 and move out of the plane of the panel section 75. Similarly, the panel section 78 is hingedly connected to panel section 79 by the fold lines 82, 83. A tab 84 is excised along the arcuate lines 85, 86 so that the tab 78*a* will be a part of the panel section 78 and will rotate therewith about the fold lines 82–83.

In the completed carton, it will be seen that the tab 74*a* is adhesively secured to the partition panel 61 extending across the fold line 60; in the completed carton, the fold line 60, with partition panel 61, will coincide with the fold lines 76–77. Similarly, in the completed carton, the tab 78a will be adhesively connected to the partition panel 63 and the fold line 62 will coincide with the fold lines 82–86.

The top panel 51–51a is provided with the additional retaining panel 90 connected thereto by the fold line 91. Similarly, the top of panel 53–53a is provided with the retaining panel 92 connected thereto by the fold line 93. It will be noted that these members 90–92, as seen in FIG. 1, serve to assist in positioning the elements placed in the four central compartments of the completed container. Similarly, the dust covers 31, 32, not only serve as dust covers, but also serve to assist in retaining in position the elements placed in each pair of cells or compartments at each end.

It should be noted that the extension 74a of panel 74 and extension 78a of panel 78 are spaced from panel sections 75 and 79, respectively, by the openings 101, 102. This ensures that these extensions 74a and 78a will bend away properly in the erection process hereinafter described and that any applied adhesive will not have the effect of extending into the panels 75 and 79 to interfere with their operation.

The blank of FIG. 2 may be die cut appropriately by a standard die cut machine or may be formed by feeding a web continuously through a die cutting machine. The blank may then be moved along and folded as it moves along the fold lines 40, 42, 46, 47 to the position shown in FIG. 3, wherein the bottom panels 41, 43 and the additional bottom panels 44, 45 have all been folded into surface-to-surface relation with the side walls 20 and 21 and the end walls 23 and 25. When the blank is in the condition of FIG. 3, adhesive may now be applied to the desired sections preliminary to completing the carton. Adhesive is applied to section 101a of panel 61 and section 102a of panel 63. Adhesive is also applied to the underside of triangular section 44b and the underside of triangular section 45b which are now on the same surface in FIG. 3 as the adhesive sections 101a, 102a. Adhesive is also applied to the glue flap 105. The various adhesive areas may be applied in a continuous manner by a roll or rolls of appropriate dimeter having glue applicating sections or by a die element or a printing element which may move with the blank or cause the blank to stand still so that adhesive is applied at these five sections of the blank.

Figure 3:
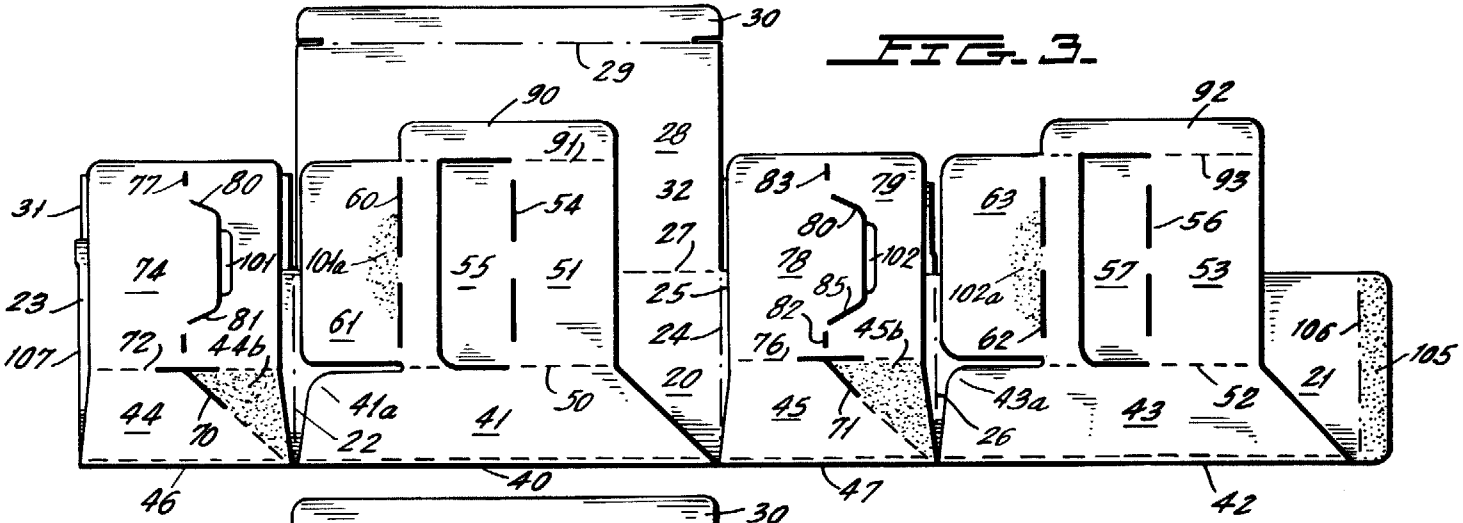
FIG. 3 is a view showing the first folding operation of the carton of the blank of FIG. 2 in order to begin the operation of forming the carton.
Figure 4:
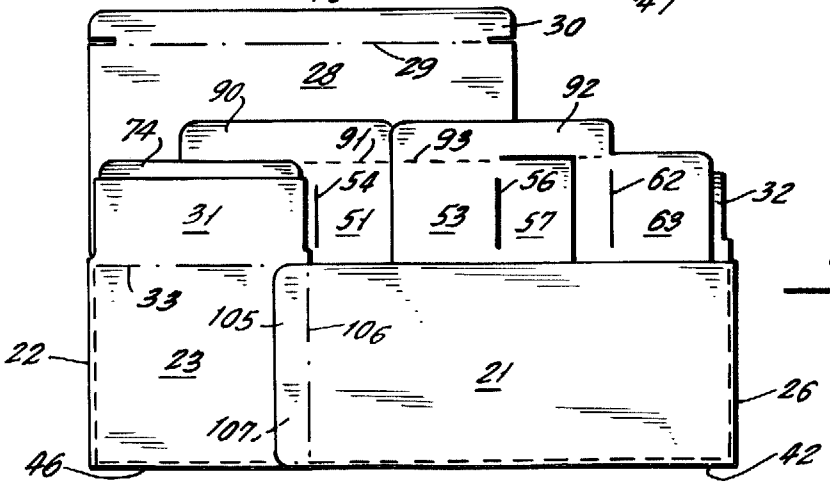
FIG. 4 is a plan view showing the second step in the operation of forming a carton in which the blank, which has been folded from the condition of FIG. 2 to the condition of FIG. 3, is now folded to the final manufactured condition. It should be noted here that at this point the carton is completed and may, by appropriate pressure at the ends, be erected into the condition of FIG. 1.

Thereafter, the blank is folded from the position of FIG. 3 to the position of FIG. 4 by rotating the end panel 23 about the fold line 22 and thereafter rotating the side panel 21 about the fold line 26 so that the glue flap 105 extending from the panel 21 and connected thereto by the fold line 106 is in surface-to-surface contact with the outer free edge of the end panel 23, as shown in FIG. 4.

At this time, an appropriate pressure roll, or other appropriate means for securing and drying the adhesive, causes the glue flap 106 to adhere to the outer edge area 107 of the side panel 23, causes the extensions 74a and 78a of the respective panels 74 and 78 to adhere to the glue applied stations 101a, 102a of the panels 61, 63 and causes the triangular sections 44b and 45b of the bottom panels 44 and 45 to adhere to the adjacent sections 41a and 43a of the bottom wall sections 41 and 43.

This application of adhesive in five places and the subsequent folding of the carton blank from the position of FIG. 2 to the position of FIG. 3 at which the adhesive is applied and then to the position of FIG. 4 serves, after appropriate pressure is applied to the glue, to complete the carton.

The carton may now be erected from the position of FIG. 4 to the position of FIGS. 1 and 5 by pressing against the edges 26 and 22 of the completed carton pushing them toward each other. The carton thereupon erects itself so that the partitions 75 and 79 extend longitudinally of the axis of the carton as an apparent continuation of the walls 51, 51a and 53, 53a. The partitions 63 and 78 at one end extend at right angles to this apparent central wall to define a pair of cells with the end wall 23 and the partitions 61 and 74 extend similarly at the other end of the carton to define, together with the section 79, a pair of cells adjacent the end wall 25.

The longitudinal partitions 53, 53a and 51, 51a also erect themselves adjacent each other and in surface-to-surface relationship to define a pair of large cells between the two first mentioned pairs of cells at the ends of the carton. The partitions 55 and 57 may then be folded out respectively from the longitudinal partitions 51–51a and 53–53a to convert the pair of double size central cells into four central cells of the same size as the pairs of the end cells.

By this means, therefore, a carton is created in collapsed form, fully manufactured, so that at the point of use it may readily be erected by squeezing the edges 26 and 22 together and automatically creating a carton having a pair of cells at each end and two larger cells between the pair of cells. These two larger cells may then readily be converted into four cells by bending out the additional partitions 55 and 57. Retainer members 90 and 92 may then be bent down over the item contained in the compartments in order to assist in retaining these members in the compartments and the dust flaps 31, 32, which are more than merely dust flaps, may be bent down over the end compartments at each end to assist in retaining in position the items or units contained in the end compartments.

By this means, therefore, it will be seen that a multi-use, erectable container is provided in which eight compartments will provide for protectively encasing eight items, preventing them from jarring against each other and closely positioning them.

In addition, the central four compartments may be converted into one larger compartment on one side and a pair of compartments similar in size to the pairs of end compartments, or the central compartments may be converted into two oversized or larger compartments. This thereby provides a container which may be utilized to ship eight articles of similar size and content or, where certain types of merchandise may require the same, the container may be used to ship four or six items of the same or similar size or similar purpose with an additional item which is larger. Thus, for instance, where certain types of glass enclosed fluids are shipped in the carton and it is desired to also ship an applicator therewith which is larger in size than the fluid containers, the central compartments are convertible so that they may be adapted for this purpose.

It will thus be seen from the foregoing that the solution to the problem providing eight compartments, rather than the six compartments previously provided, or the provision of larger central compartments which may be divided into smaller compartments of equal size with the end compartments, is not merely a matter of adding additional paper, but is the result of the discovery that the longitudinal sections of the central compartment members may be extended longitudinally to provide central compartments of larger size than the pairs of end compartments and that even these longitudinal members may be provided with additional flaps or panels which, in turn, may be folded back and not used, leaving the central compartments larger, or may be folded out and used to create a structure having eight equal sized compartments.

Figure 7:
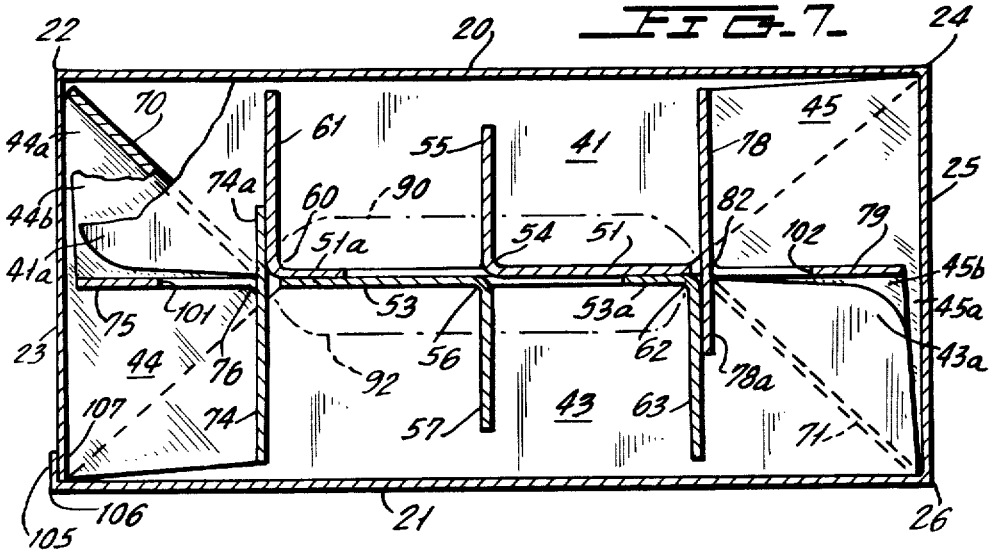
FIG. 7 is a view partly in section of the carton of FIG. 1, taken on line 7—7 of FIGS. 1 and 5.
Figure 8:
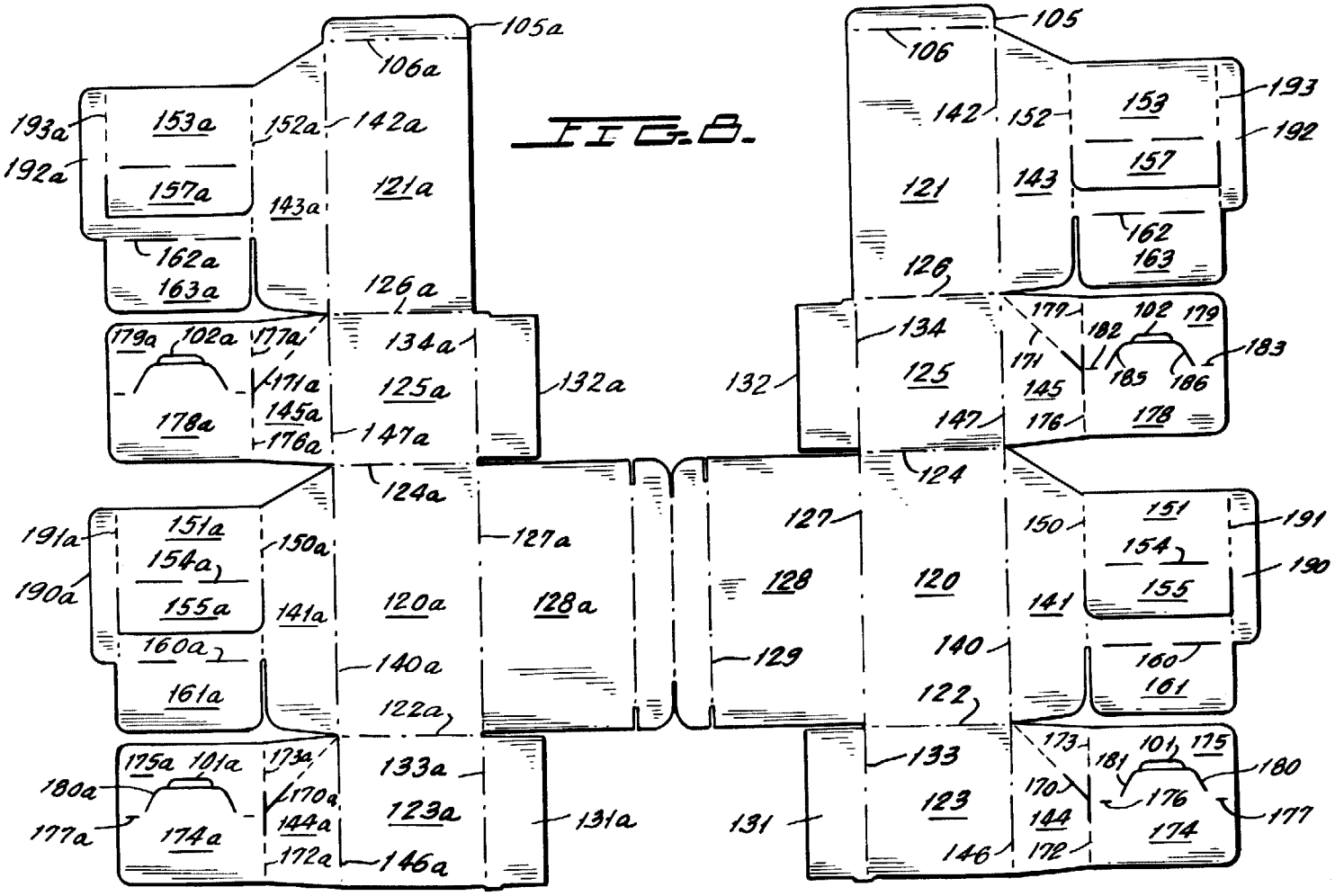
FIG. 8 is a plan view of a blank which may be used to form a multiple cell row carton of the type shown in FIG. 9.
Figure 9:
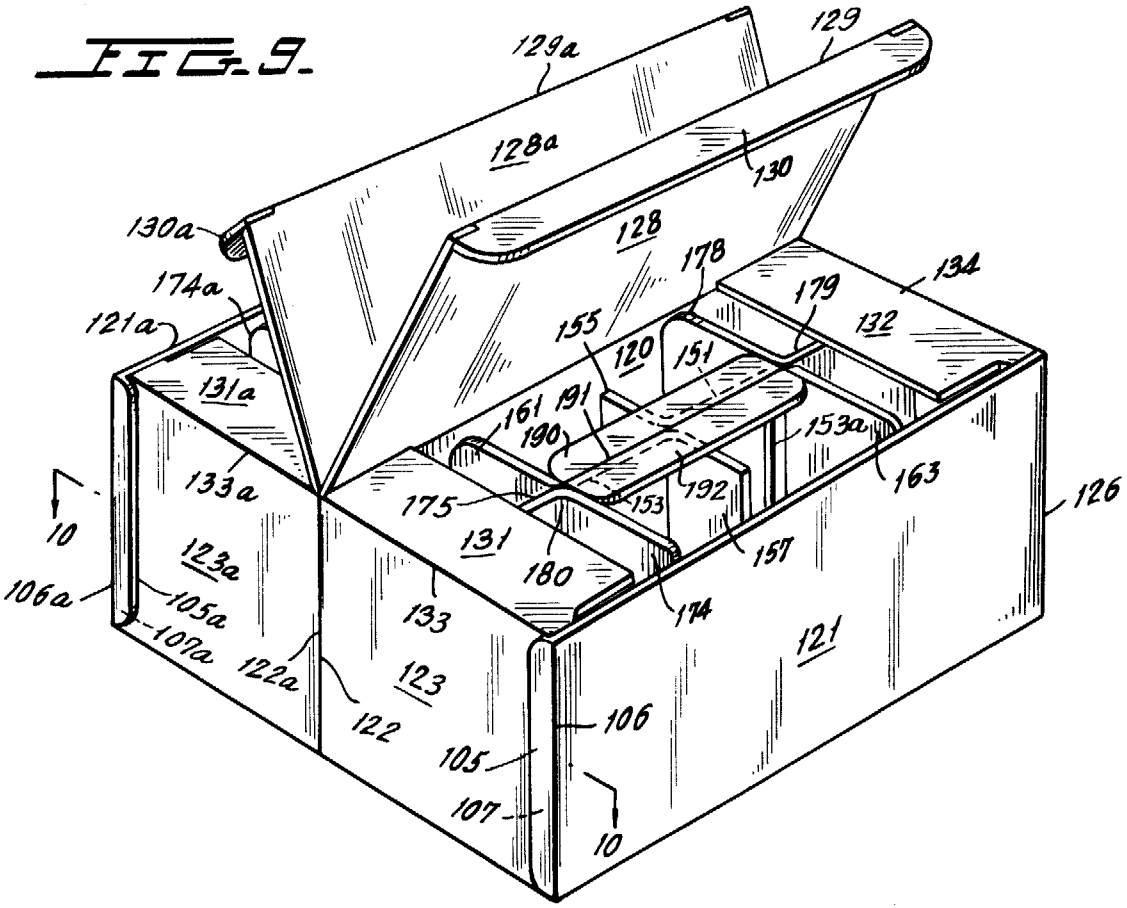
FIG. 9 is a view in perspective of a multiple cell row carton consisting of four rows of cells of the general type shown in FIGS. 1 and 2 made from a single blank and erected simultaneously.
Figure 10:
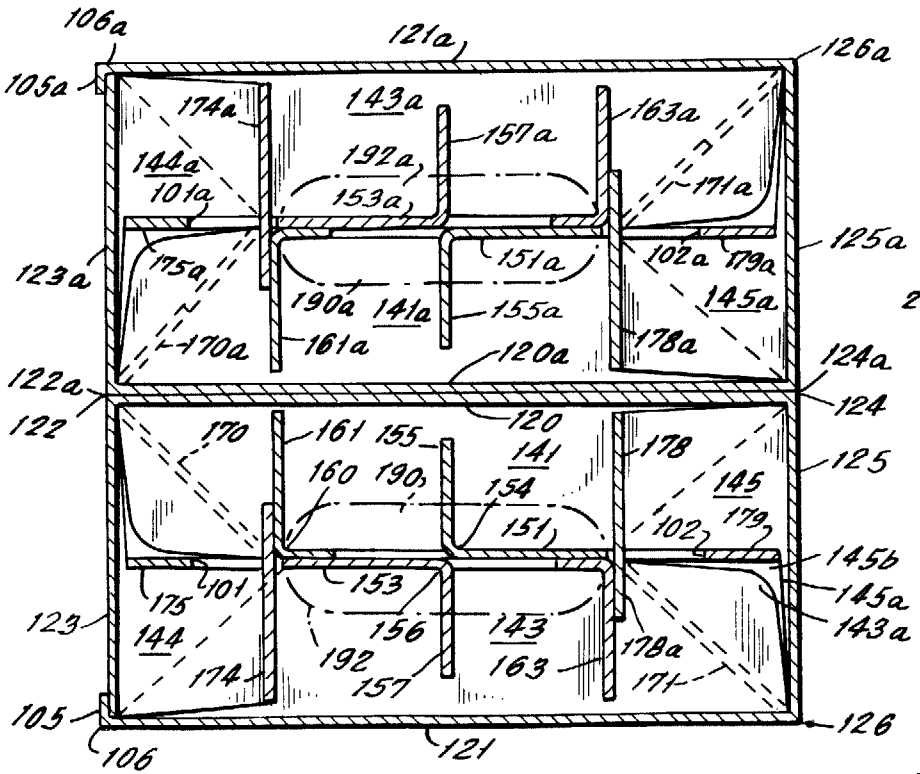
FIG. 10 is a cross-sectional view of the quadruple row carton structure shown in FIG. 9.

While, in the foregoing, a convertible eight cell carton has been described consisting of two rows of four cells in which the center cells may be convertible to a single cell, thereby making it possible to have six, seven or eight cells, the essence of the present invention is not limited to that particular configuration. As seen in FIGS. 8, 9 and 10, the multiple cellular carton consisting of a plurality of rows of cells may be manufactured to have not merely two rows of four cells each (one of which is convertible), but may have four rows of the same number of cells each. It is also possible as hereinafter described to add longitudinally to each row so that each row will have not merely four cells (convertible to three) but may have six or more. In the structure shown in FIGS. 8, 9 and 10, the blank for the carton is duplicated along the edge 140 to provide an additional structure consisting of a mirror image of the original blank of FIG. 2 so that the two blanks form what appear to be two separate cartons which are duplicates of each other. The blank on the left, since it is a duplicate of the blank on the right in FIG. 8, has been given reference numbers corresponding to the blank on the right plus the letter A. The blank on the right has been given the same reference numbers as the blank in FIG. 2 plus 100 so that for instance lid 128 in FIG. 8 corresponds exactly to lid 28 of FIG. 2. Lid **128*a* in FIG. 8 is a mirror image of and corresponds to lid 128 of FIG. 8. By reference to FIGS. 9 and 10 it will be seen that the cartons may be folded up and glued up in tandem in exactly the same way as previously described with respect to FIGS. 1–7 except that the two carbons will be formed. The walls 120 and 120*a* are preferably adhesively secured together at the abutting sides thereof in order to form a composite double carton. The tuck-in flaps 130 and 130*a* of the lids 128 and 128*a* are slit apart at the edge 140 so that two separate lids are provided. In this way the carton structure may be doubled with two separate lids being provided. Each of the carton sections of FIGS. 9 and 10 may be treated in the same way as the carton sections of FIGS. 1 and 7. If it is desired to avoid the slitting operation along the line 140, then the lid 128 and 128*a* on each side may be reduced to merely a dust flap and the glue flap 105*a*** may be extended in order to form a longitudinal lid.

Figure 12:
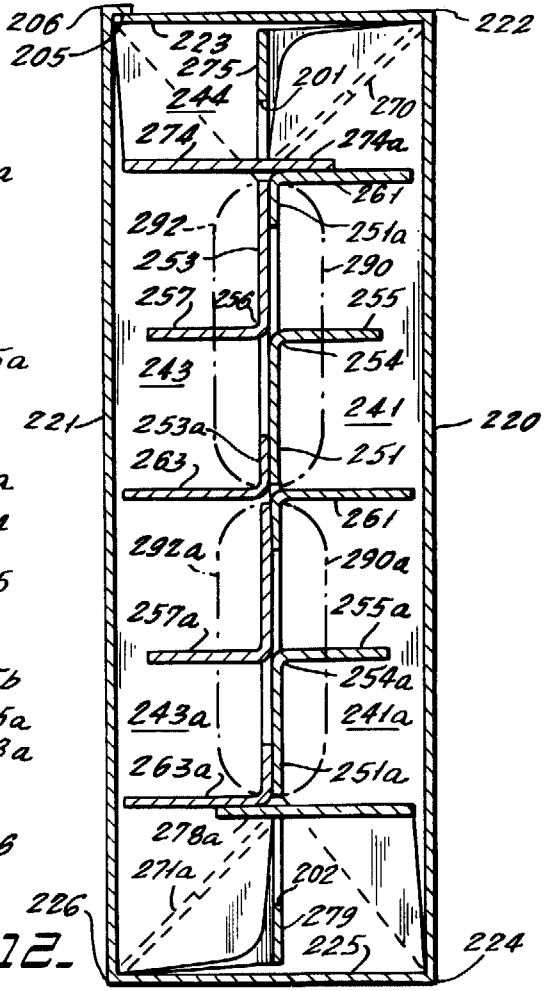
FIG. 12 is a view in perspective of the carton formed from the blank of FIG. 11.
Figure 11:
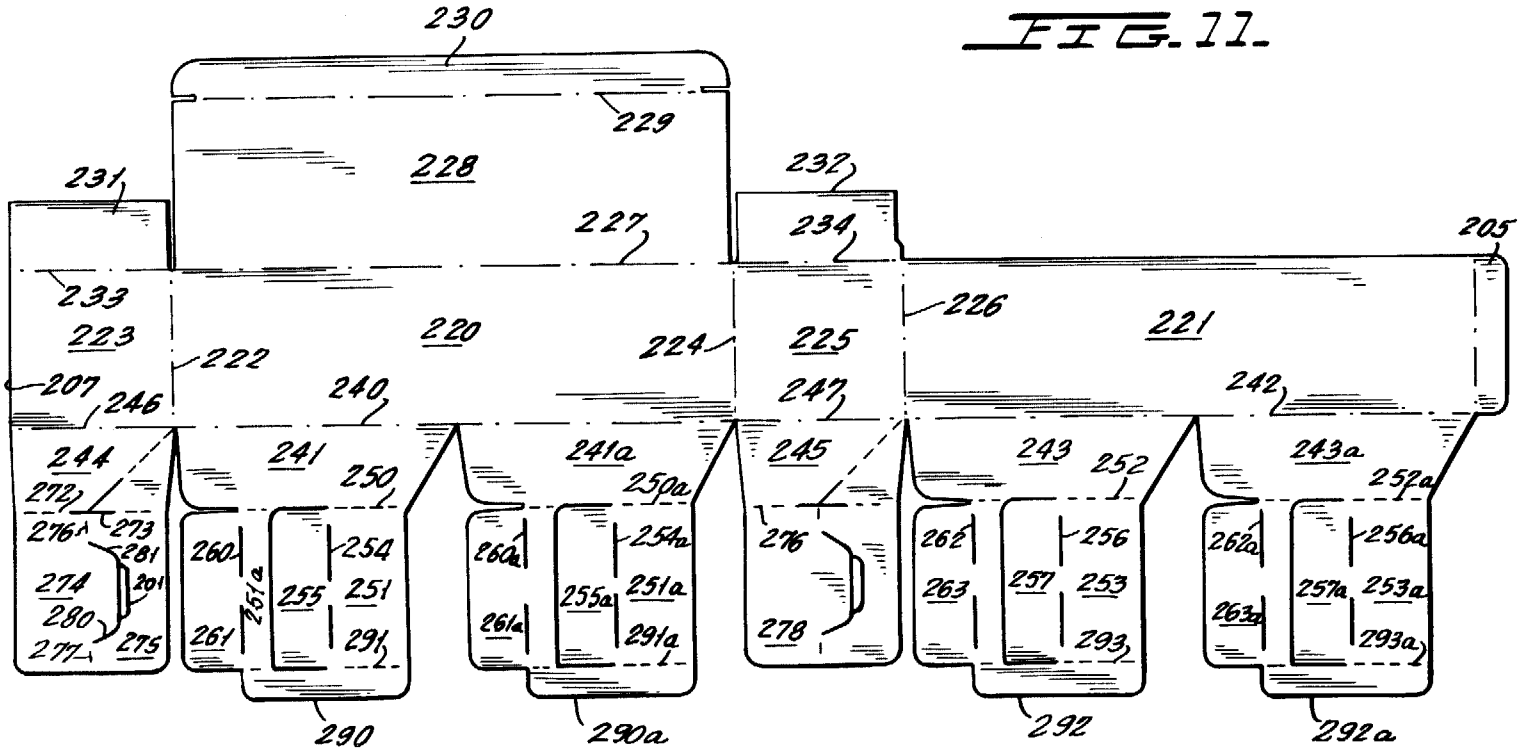
FIG. 11 is a plan view of a modified form of blank order to create a carton having twelve cells, six on each side.

In FIGS. 11 and 12 there is shown a further modification of the carton structure wherein the carton may be extended in order to double the number of cells. In this structure, the original panel 41 and 43 of the blank of FIG. 2 are extended to double their length with the corresponding side walls 20 and 21 being correspondingly extended to form the panels 241 and 243 respectively. Likewise the panels 61 and 63 the blank of FIG. 2 are doubled in length to provide a plurality of sets of partitions 255 and 257. This provides a pair of adjacent compartments in each row, each of which pair of compartments can be used as four cells, two cells or three cells by folding in the flaps as previously described. In this way therefore a larger carton with a greater number of cells is created. The convertible center cells now comprise four cells in each row or eight cells in all. These eight cells may be converted from eight cells to six cells and even down to four larger cells. The eight cells thus provided plus the two cells at each end produce a twelve cell structure. This twelve cell structure may in addition be duplicated in the manner shown in connection with FIGS. 8, 9 and 10 to provide not merely two rows comprising twelve cells or six in each row, but also to provide four rows of such cells or twenty-four in all in which the center groups of cells may be converted from regular size cells into double size cells.

In the foregoing, the present invention has been described solely in connection with a preferred illustrated embodiment thereof. Since many variations and modifications of the present invention will now be obvious to those skilled in the art, it is preferred that the scope of this invention be determined not by the specific disclosures herein contained but only by the appended claims.

What is claimed is:

1. An erectable, unitary multicell carton comprising a pair of side walls and a pair of end walls connected to form a rectangular carton, a bottom wall comprising a pair of bottom panels each extending from the lower edge of one of the side walls, each of said bottom panels extending longitudinally of the carton between the end walls to form a single bottom wall which has a juncture line along the longitudinal axis of the carton;

central partition panels extending upwardly from the bottom wall panels at the longitudinal axis of the carton when the carton is erected, said central partition panels extending parallel to the side walls; first additional partition panels extending from the end walls and second additional partition panels extending from the first mentioned central partition panels extending from the bottom walls;

said first additional partition panels extending from the end walls and said second additional partition panels extending from said bottom wall panels cooperating to form partitions parallel to said central partition panels;

said first additional partition panels each having third additional partitions connected normal thereto and extending along said longitudinal axis to form end sections of the central partition of the erected carton;

said end sections aligned with said central partition panels from the bottom wall panels to complete the longitudinal partition;

said central partition panels extending from the bottom wall panels having fourth additional panels foldably connected thereto and positioned centrally of said end walls and at right angles to said central partition panels extending from the bottom wall, wherein said carton when erected forms a carton with a pair of cells at one end of size equal to each other, a pair of cells at the opposite end of a size equal to each other and a pair of central cells on each side of the longitudinal partition between said first mentioned two pairs of cells.

2. The erectable, multicell carton of claim 1, wherein said central partition panels are longer than the first additional panels extending from said end walls.

3. The erectable, multicell carton of claim 2, wherein the central cells formed by said central partition panels are double the size of the cells adjacent said end walls.

4. The erectable, multicell carton of claim 2, wherein said central cells formed by said central partition panels are selectively available as cells of double the size of the pairs of cells at each end of the carton and, by reason of being provided with said fourth additional panels foldable out transverse to said central partition panels, are each convertible individually into cells of size equal to the end cells.

5. The erectable, multicell carton of claim 4, wherein said carton may be utilized as an eight-cell carton with the cells of equal size and selectively as a seven-celled carton with one of the two central cells having its foldable panel folded back to provide a single, larger compartment and also selectively usable as a six-celled carton with two pairs of end cells of equal size and the two compartments between them of double size.

6. The erectable, multicell carton of claim 1, wherein the top edges of said central longitudinal panels have retainer panels foldably connected thereto.

7. The erectable, mutlicell carton of claim 1, wherein the top edges of the end walls have duct excluding retainer panels foldably connected thereto.

8. The erectable multi-cell carton of claim 4, wherein the carton consisting of eight cells with certain of the cells being convertible is formed as a double carton consisting of four rows of four cells each at east one pair of cells in each row being convertible, said double carton comprising two basic cartons having a common longitudinal side wall to form a pair of rows of cells, outer and adjacent walls of the cartons being adhesively secured together.

* * * * *